United States Patent [19]

Kerr

[11] Patent Number: 4,819,292

[45] Date of Patent: Apr. 11, 1989

[54] TRANSMISSION DEVICE FOR PLUMBING SNAKES

[76] Inventor: Stanton W. Kerr, 4164 Calavo Dr., La Mesa, Calif. 92041

[21] Appl. No.: 106,814

[22] Filed: Oct. 13, 1987

[51] Int. Cl.[4] ..... B08B 9/02

[52] U.S. Cl. ..... 15/104.33

[58] Field of Search ..... 15/104.33, 104.31; 279/99; 254/134.3 FT

[56] References Cited

U.S. PATENT DOCUMENTS

| | | | |
|---|---|---|---|
| 2,240,087 | 4/1941 | Barrett | 15/104.33 |
| 2,266,659 | 12/1941 | Robinson et al. | 15/104.33 |
| 2,278,067 | 3/1942 | Emery | 15/104.33 |
| 2,467,849 | 4/1949 | O'Brien et al. | 15/104.33 |
| 2,562,574 | 7/1951 | Poekert | 15/104.33 |
| 2,617,135 | 11/1952 | Larsen | 15/104.33 |
| 2,955,307 | 10/1960 | Hunt | 15/104.33 |
| 3,317,943 | 5/1967 | Primm | 15/104.33 |
| 4,291,429 | 9/1981 | Serradio | 15/104.33 |

*Primary Examiner*—Edward L. Roberts

[57] ABSTRACT

The present invention relates to a power transmission device for use with a plumbing snake and a conventional hand-held drill motor to selectively extend, retract, and/or rotate the plumbing snake when positioned in a drain or sewer pipe system for clearing blockages or debris from the system. The snake is caused to extend or retract from the transmission by engagement of its coils with a threaded bore of a driven member engaged with a drive member rotated by the drill motor. Rotational motion of the snake is achieved through a brake device locking the snake and driven member together.

6 Claims, 2 Drawing Sheets

FIG. 3
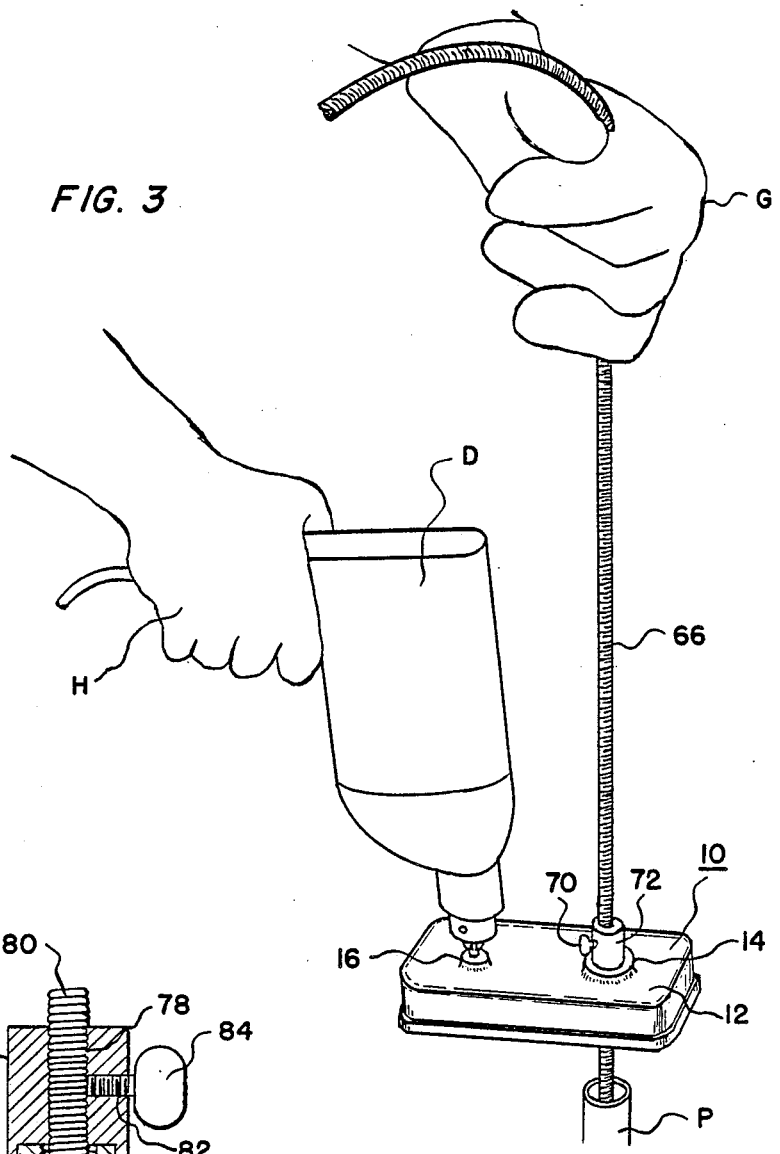
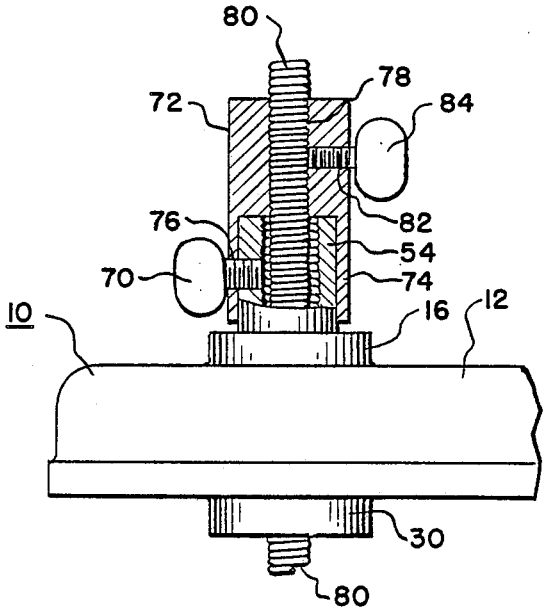
FIG. 4

TRANSMISSION DEVICE FOR PLUMBING SNAKES

BACKGROUND OF THE INVENTION

For many years plumbers and homeowners have utilized a device known in the plumbing art as a plumbing snake to clear blockages from drain and sewer pipes in buildings and homes. Plumbing snakes are generally made from tempered steel wire wound into an elongated helical configuration with an enlarged auger head terminating in a pointed end. They are manufactured in a variety of sizes adaptable for use in pipes of various diameters. Thus a snake suitable for use in a standard size kitchen drain or bathroom lavatory drain may be of considerable smaller diameter and wire size than a snake used in sewer systems. Plumbing snakes and related accessories range from hand operated types to power driven types of which there are many variations and options to choose from. Of those in the power driven category, motor power is utilized to transmit rotational motion to the snake to aid in negotiating around an elbow or bend or other change in direction as well as for snagging debris blocking or obstructing the flow of waste material lodged within the pipe. Insertion of the snake into the pipe is accomplished by manually pushing the snake into the pipe until such time as resistance is felt. The snake is then rotated by energizing the power source such as an electric motor to aid in negotiating around the elbow or snagging the obstructing material. In one version of the powered type, the flexible wire snake is contained within a drum or cage. The snake passes through an axially disposed tube connected to the drum. Another example of a powered type utilizes a conventional drill motor coupled to one end of a flexible snake to effect rotation while the auger end of the snake is being telescopically hand fed into the clogged pipe.

SUMMARY OF THE INVENTION

In the transmission device for plumbing snakes of the instant invention, a power source such as a conventional hand-held electric drill motor is attached by means of its chuck to a shaft journalled in and protruding from a housing of the transmission device. A disc-shaped drive means contained within the housing is secured to the drive shaft. A second disc-shaped driven means journalled in the housing engages the periphery of the drive means and is thus rotated upon energizing the hand drill motor. The driven means is provided with an axial bore which is threaded to match the helical convolutions of a conventional plumbing snake. The plumbing snake extends through the threaded bore of the driven disc means. Longitudinal extension and retraction of the plumbing snake through the driven disc means is effected by restricting rotational movement of the snake while the hand drill motor is rotating the driven disc. When it is desired to rotate the plumbing snake, a thumb screw projecting into the threaded bore of the driven means is tightened against the snake to prevent relative motion between the snake and disc. Various size snakes are accommodated for use in the transmission device by securing an adapter to the driven means. The adapter is axially bored and threaded to correspond with the helical convolutions of a smaller diameter plumbing snake.

It is therefore an object of the present invention to provide a transmission device for plumbing snakes capable of selectively imparting rotary and longitudinal movement to a plumbing snake engaged therewith.

Another object is to provide a transmission device for plumbing snakes in which a plumbing snake engaged therewith may be rotated concurrently with longitudinal movement thereof.

Still another object of the present invention lies in a transmission device for plumbing snakes adapted for use with a conventional drill motor device.

Another object of this invention is to provide a transmission device for plumbing snakes embodying reversing means for longitudinal extension and retraction of the plumbing snake.

A further object of this invention is to provide a transmission device for plumbing snakes suitable for use by unskilled persons.

Yet another object of this invention resides in a transmission device for plumbing snakes embodying adapter means to accommodate a variety of different size plumbing snakes.

Another object of this invention lies in its simplicity and economical construction of the transmission device for plumbing snakes.

Another object of the present invention lies in the ability of the transmission device for plumbing snakes to prevent damage such as kinks and/or uncoiling of the plumbing snake upon encountering a resistance against rotation within a sewer or drain pipe in excess to the tempered strength of the snake.

Other objects and advantages will become apparent to those skilled in the art from the following specification.

BRIEF DESCRIPTION OF THE DRAWINGS

FIG. 3 is a perspective view of the transmission device showing it attached to a conventional electric hand drill with the plumbing snake thereof extended into a drain pipe, and, FIG. 4 is a partial front elevational view of the transmission device illustrating the attachment of an adapter to accommodate a plumbing snake of lesser diameter than that as shown in FIGS. 1 and 2.

DETAILED DESCRIPTION OF THE INVENTION

Figure 1:
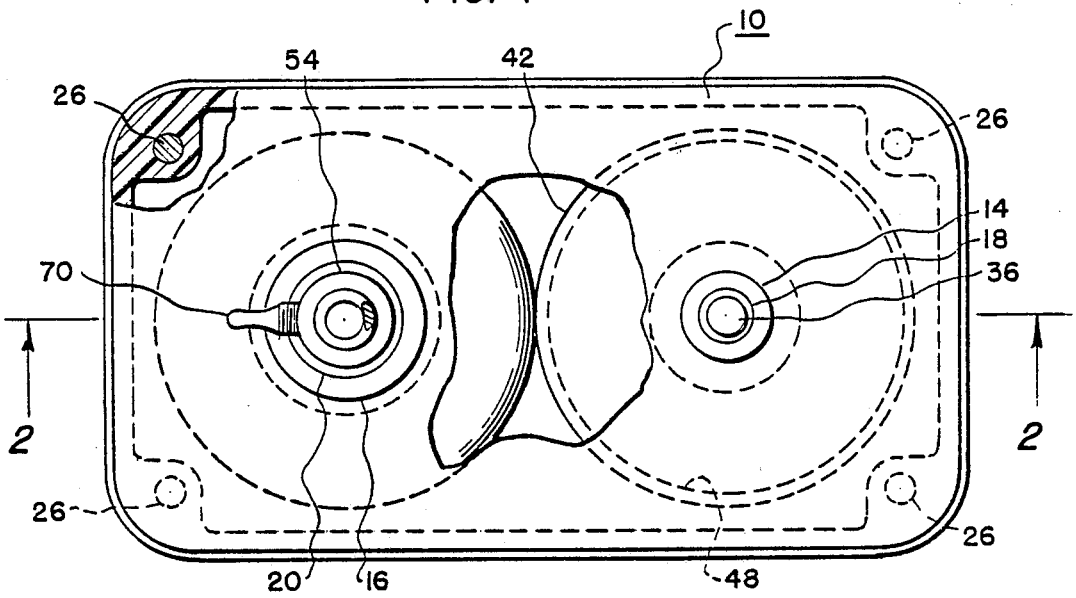
FIG. 1 is a top or plan view of the transmission device for plumbing snakes with portions broken away and in section to facilitate the illustration.

A housing generally indicated by the numeral 10 consists of an hollowed-out upper member 12 having raised bosses 14, and 16 in which sleeve type bearings 18 and 20 are mounted. Upper member 12 is provided with a recessed lower edge 22 to receive a flush-mounted lower member 24 secured to upper member 12 by suitable fasteners such as screws 26 countersunk into lower member 24 and threaded into upper member 12. Bosses 28 and 30 of lower member 24 mount sleeve type bearings 32 and 34 in axial alignment with bearings 18 and 20 respectively of upper housing member 12. Housing 10 is preferably molded from a suitable hard plastic material such as ABS (acrylonitrile butadiene styrene) in order to achieve an ideal strength-to-weight ratio but may be cast from a suitable light-weight metal such as aluminum if desired. A shaft 36 has its upper extension 38 journalled in and projecting through bearing 18 of upper housing member 12 and its lower extension 40 journalled in and projecting through bearing 32 of lower housing member 24. Shaft 36 is preferably made of hardened steel and is of a suitable diameter for insertion into the jaws of a conventional powered hand-drill chuck. Molded onto shaft 36 and positioned within the cavity formed by housing upper and lower members 12 and 24, is a disc-shaped drive means 42. Washers 44 and 46 are sandwiched between disc 42 and the inner surface of upper and lower housing members 12 and 24 respectively. Disc 42 is recessed at 48 around the outer circumference thereof to receive a friction band or tire 50. A driven means 52 in parallel relationship to the axis of drive means 36 has its hardened steel shaft 54 journalled in bearings 20 and 34 of upper and lower housing members 12 and 24 respectively. Shaft 54 is preferably of hardened steel material having serrations 56 intermediate the ends thereof on which a disc-shaped wheel 58 is molded. Wheel 58 is positioned inside the cavity formed by upper and lower housing members 12 and 24 for peripheral drive by engagement with tire 50 of drive means 42. Washers 60 and 62 space the hub of wheel 58 from the interior surfaces of upper and lower housing members 12 and 24. Wheel 58 and drive means 42 are preferably molded from a hard plastic material such as ABS similar to that of the material of upper and lower housing members 12 and 24. Shaft 54 is axially bored and threaded at 64 to match the helical convolutions of a plumbing snake 66 threadably engaged therewith. Shaft 54 projects above boss 16 of upper housing member 12 and is bored and threaded at 68 through the wall thereof into the threaded bore 64. A friction device or brake 70 is threadably engaged with threads 64 of shaft 54. Brake 70 may be in the form of a thumb screw as shown to facilitate hand operation.

Figure 2:
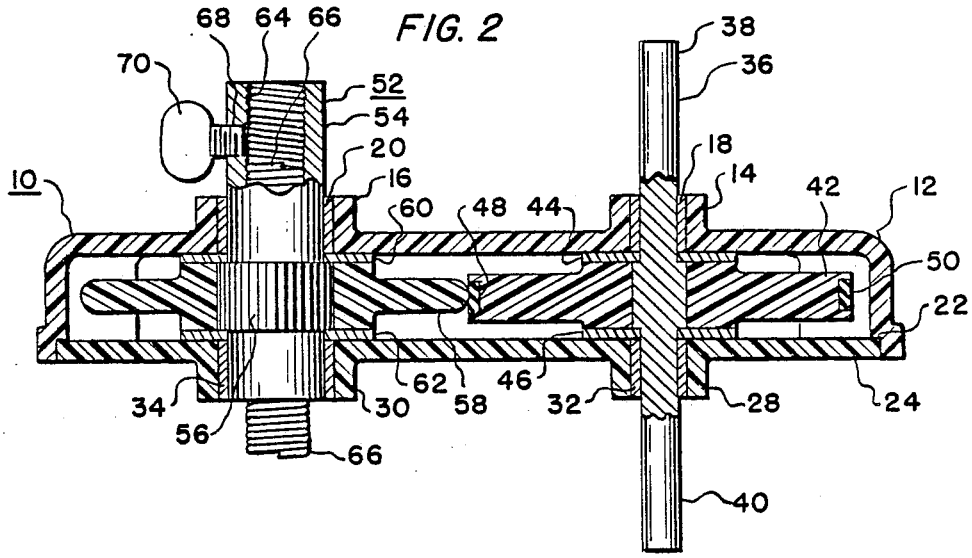
FIG. 2 is a cross-sectional view taken along the line 2—2 of FIG. 1 with portions shown in elevation.

At this point it should be noted that the particular mechanism employed to transmit rotary motion from the drive to the driven means as shown in FIGS. 1 and 2 of the drawings may take various other forms without departing from the spirit of the invention. For example, in lieu of the peripheral disc drive as shown, a belt driven pulley arrangement or pairs of meshed gears may suffice to-transmit rotary power motion if so desired. However, the plastic disc as peripherally driven by the rubber tired plastic disc affords safety to the operator as well as preventing damage to the plumbing snake. This arrangement allows slippage to occur between the two discs in the event the auger of the snake becomes entangled in debris within the drain pipe and is locked against further rotation.

It is further to be noted that if so desired, snake 66 may be manually extended or retracted from within the threaded bore of shaft 54. For example, shaft 54 may be formed in separate sections split longitudinally for radial separation or expansion. One section may be connected to or integral with shaft 54 of driven means 52 and the remaining section longitudinally hinged to shaft 54 to form a gate. The individual sections are secured together during powered operation and opened during manual operation to facilitate longitudinal extension or retraction of snake 66 from shaft 54.

Referring now to FIG. 4, an adapter 72 is axially bored at 74 and is telescopically mounted over shaft 54 of driven means 52 after first removing thumb screw 70 therefrom. Adapter 72 is secured to shaft 54 by reinstalling thumb screw 70 through an opening 76 in the side wall thereof and into the threaded bore 68 of shaft 54. A reduced diameter threaded bore 78 in axial alignment with bore 74 receives the helical convolutions of a smaller diameter plumbing snake 80. The side wall of adapter 72 is bored and threaded at 82 to receive the threaded shank end of a second thumb screw brake 84.

DESCRIPTION OF THE OPERATION

Referring to the illustration of FIG. 3, a power source such as a conventional hand-held electric drill motor D is coupled to the transmission device by tightening the drill chuck onto the upper end 38 of the shaft 36. The auger end of the snake 66 is thereafter inserted into a pipe P to be cleared of debris or other obstructions. The gloved hand G of the operator grasps the plumbing snake 66 (or snake 80 when the adapter 72 is used) while holding the trigger handle of the drill motor D with hand H. Thus the transmission device is supported by the operator through the drill motor D and the snake 66. In order to extend snake 66 into pipe P, the operator activates the trigger of the drill motor D while tightening the grasp of gloved hand G about snake 66 to prevent its being rotated. As the shaft 36 together with drive means 42 and driven means 52 rotates, snake 66 is caused to advance through threads 64 of the shaft 54. As snake 66 is extended into pipe P, it becomes necessary for the operator to reposition gloved hand G to a new position as the snake 66 moves downward toward housing 10. When the auger of snake 66 strikes an obstruction in pipe P, drill motor D is stopped while the operator tightens the thumb screw of brake 70. Drill motor D is then re-activated while the operator's gloved hand G holds snake 66 loosely for guidance and support only while the snake is rotating in concert with the rotation of shaft 54. When it is desired to advance the snake 66 into the pipe P concurrently with rotation thereof, the operator tightens the grasp of gloved hand G about snake 66 to slow but not stop rotation of the snake. In the event the snake auger becomes entangled in debris within pipe P and is locked against rotational movement, damage such as kinking and uncoiling of the snake is prevented by slippage between the brake 70 and snake 66 and/or slippage between the drive means 42 and driven means 52.

Many present day drill motor manufacturers incorporate variable speed and reversibility in their designs. However, drill motors, especially drill motors of an older generation, may lack these features. When a non-reversible drill motor is being used, in order to retract or withdraw snake 66 from pipe P, it becomes necessary to release the chuck of the drill motor D from its connection with upper end 38 of shaft 36 and re-connect it to the lower end 40 thereof. Thus when the single direction drill motor is activated, the shaft 54 will rotate in the opposite direction. Tightening of the operator's grasp of snake 66 will result in withdrawal of the snake from pipe P.

Other modifications, applications and ramifications of the present invention will become apparent to those skilled in the art upon reference to this disclosure. It is intended that such be included within the scope of this invention as defined in the appended claims.

I claim:

1. A transmission device for plumbing snakes comprising, a housing, drive means journalled in said housing, driven means journalled in said housing, said drive means engaging said driven means, said driven means having a threaded bore, an adapter releasably secured to said driven means, said adapter having a threaded bore, said threaded bore of said adapter being of smaller diameter than said threaded bore of said driven means.

said threaded bores of said driven means and said adapter being in axial communication with one another, and a flexible helically-coiled wire plumbing snake threadedly engaged with said threaded bore of said adapter.

2. The transmission device for plumbing snakes as defined in claim 1 wherein:

a brake is mounted on said driven means engageable with said snake whereby upon engagement therewith, said snake and said driven means are locked together for transmitting rotational motion to said snake.

3. The transmission device for plumbing snakes as defined in claim 2 wherein;

said drive means is mounted on a shaft, and said shaft extends outside of said housing for connection to a power source.

4. A transmission device for plumbing snakes comprising;

a housing, said housing having an upper and lower member;

fasteners securing said upper and lower housing members together, bearings mounted in said upper and lower housing members, drive means positioned within said housing, said drive means being of disc-shaped configuration, a shaft extending from said drive means, said shaft journalled in an axially aligned pair of said bearings, said shaft extending above said upper housing member and below said lower housing member, driven means positioned within said housing, a shaft extending from said driven means, said shaft journalled in an axially aligned pair of said bearings in parallel relationship to said shaft of said drive means, said shaft extending above said upper housing member, said driven means being of disc-shaped configuration, said drive means and said driven means having their peripheral edges frictionally engaging one another, said shaft of said driven means having an axially threaded bore and a flexible helical-coiled wire plumbing snake threadedly engaged with said threads of said shaft of said driven means.

5. The transmission device for plumbing snakes as defined in claim 4 wherein;

a brake is mounted on said shaft of said driven means above said upper housing member.

6. A transmission device for plumbing snakes comprising;

a housing, drive means journalled in said housing, a shaft extending from said drive means for connection to a power source, driven means journalled in said housing, said drive means engaging said driven means, said driven means having a threaded bore, a flexible helically-coiled wire plumbing snake threadedly engaged with said threaded bore of said driven means, said snake being extendable from said threaded bore of said driven means upon activation of said power source, and a brake mounted on said driven means engageable with said snake whereby upon engagement therewith, said snake and said driven means are locked together to transmit rotational motion to said snake upon actuation of said power source.

* * * * *